US007121867B2

(12) United States Patent
Annecke

(10) Patent No.: US 7,121,867 B2
(45) Date of Patent: Oct. 17, 2006

(54) ELECTRICAL PIN-AND-SOCKET CONNECTOR

(75) Inventor: Alfred Annecke, Heilbronn (DE)

(73) Assignee: Amphenol-Tuchel Electronics GmbH, Heilbronn (DE)

( * ) Notice: Subject to any disclaimer, the term of this patent is extended or adjusted under 35 U.S.C. 154(b) by 0 days.

(21) Appl. No.: 11/312,544

(22) Filed: Dec. 21, 2005

(65) Prior Publication Data

US 2006/0154510 A1 Jul. 13, 2006

(30) Foreign Application Priority Data

Jan. 13, 2005 (DE) ..... 10 2005 001 515

(51) Int. Cl.
*H01R 13/627* (2006.01)

(52) U.S. Cl. ..... 439/352; 439/188

(58) Field of Classification Search ..... 439/352, 439/188, 489; 200/51.09
See application file for complete search history.

(56) References Cited

U.S. PATENT DOCUMENTS

| | | | | |
|---|---|---|---|---|
| 5,275,575 | A * | 1/1994 | Cahaly et al. | 439/188 |
| 5,314,345 | A * | 5/1994 | Cahaly et al. | 439/188 |
| 6,435,894 | B1 * | 8/2002 | Little et al. | 439/352 |
| 6,530,799 | B1 * | 3/2003 | Regnier et al. | 439/352 |
| 6,663,411 | B1 * | 12/2003 | Little | 439/352 |
| 6,705,886 | B1 * | 3/2004 | Brown | 439/489 |
| 2002/0160645 | A1 * | 10/2002 | Nagamine et al. | 439/352 |
| 2004/0127087 | A1 | 7/2004 | Hirschmann | |
| 2004/0248475 | A1 | 12/2004 | Seminara et al. | |

FOREIGN PATENT DOCUMENTS

| | | |
|---|---|---|
| EP | 0 734 100 | 9/1996 |
| EP | 1 130 692 | 9/2001 |
| EP | 1 130 692 A2 | 9/2001 |
| EP | 1 253 680 | 10/2002 |
| EP | 1 130 692 A3 | 1/2004 |
| EP | 1 420 487 A1 | 5/2004 |

OTHER PUBLICATIONS

European Search Report, dated Mar. 14, 2006.

* cited by examiner

*Primary Examiner*—Michael C. Zarroli
(74) *Attorney, Agent, or Firm*—Blank Rome LLP

(57) ABSTRACT

The invention concerns an electrical pin-and-socket connector, in particular for use between a socket (primer) and an electrical control unit for a retention system in motor vehicles, which provides for the locking of the pin-and-socket connector with a long-lasting connecting and engaging and disengaging ability in its locked position, to a great extent tension-free.

8 Claims, 13 Drawing Sheets

ELECTRICAL PIN-AND-SOCKET CONNECTOR

BACKGROUND OF THE INVENTION

1. Field of the Invention

The invention concerns an electrical pin-and-socket connector, in particular for use between a socket (primer) and an electrical control unit for a retention system in motor vehicles, for example an airbag.

2. Description of the Related Art

Such a pin-and-socket connector should have the smallest possible dimensions due to the meager space available in the retention system. From this it follows that individual components of the pin-and-socket connector or associated socket, if applicable, are to have only an extremely small structural size, yet with respect to use involving safety regulations (for example, belt tighteners, airbags) a light assembly on the one hand and a high operational safety on the other is required.

This is so especially with respect to the locking of the connector and socket, whereby the contact elements of the components in the locked state must make secure contact. In the same way, the connector and socket may not inadvertently be detached from one another.

The known pin-and-socket connectors have a controlled latching bar, which is locked so it cannot operate in the initial position and can be moved only in the end position (locked position) if the pin-and-socket connector is inserted into the socket part (primer). The pin-and-socket connectors are essentially made of plastic, whereby the controlled latching bar is at least in part live in the locked end position.

If an external force acts on a plastic, the plastics behave in different ways. Thermoplasts react to an applied force with a continuing force effect (flowing). The flowing is nonreversible and is visible as a deformation. Duroplasts and elastomers do not display this behavior because only a reversible, elastic deformation takes place due to their complete cross-linkage. The flowing can occasionally lead to malfunctions of the latching bar.

If the pin-and-socket connector comes loose after some time and then needs to be put together again, putting it back together again can be problematic due to the remaining deformation of individual components.

SUMMARY AND OBJECT OF THE INVENTION

The task of the present invention is therefore to create an electrical pin-and-socket connector that can be put together again even after coming loose after a long time.

The basic idea of the present invention is to design the model and geometrical arrangement as well as the interaction of the individual components in such a way that at least in the end position or the locked position of the pin-and-socket connector the controlled latching bar or the secondary locking mechanism provides for the locking of the pin-and-socket connector to a great extent tension-free or essentially unstressed.

A locking arm of the secondary locking mechanism, designated hereafter as an actuator, produces the locking connection in the pre-lock position through at least one blocking rib, which works together with the case of the pin-and-socket connector. The secondary locking mechanism, which is formed from a basis plate and at least one of the essentially vertically extending operational elements (for example, the actuator), can be positioned in an L-shaped structural form of the pin-and-socket connector in such a way that through pressure on the basis plate the pin-and-socket connector is inserted in the primer or socket with contact connections and directly thereafter the secondary locking mechanism is immersed in the case through the release of a bar on the actuator.

In so doing, a shorting bar can be opened by an opening finger on the secondary locking mechanism. Through a guiding bar on the secondary locking mechanism the loosening of the primary locking mechanism from the socket can be prevented, as the guiding bar takes hold of the primary locking mechanism from behind.

To raise the safety and operational capability of the secondary locking mechanism it has four actuators with the corresponding bars and blocking ribs, whereby the actuators are positioned on the four corner points of the basis plate of the secondary locking mechanism.

Through the force-free end position of the actuator during the injection of the primer and the resulting prevention of the flowing of the material, the operational capability of the mechanism may be improved even after years of use.

In its most general working form the present invention concerns an electrical pin-and-socket connector with the following properties:

1. A case for receiving especially electrically connected contact elements for making contact with corresponding contact parts of the socket, whereby the case has a primary locking element to lock the case with the socket, 2. A secondary locking mechanism guided relative to the case with at least one actuator that projects essentially vertically from the basis plate of the secondary locking mechanism, 3. The secondary locking mechanism is capable of being moved back and forth between a pre-locking position for locking with the case and a locked end position for locking with the socket, 4. The actuator is shaped so it is springy and it is positioned in the end position so it works with a recess of the socket in such a way that the actuator is essentially unstressed and the secondary locking mechanism is positioned behind the primary locking device so it can take hold of it.

The construction is further simplified and accordingly space is saved as the actuator and primary locking mechanism lock into the same recess of the socket in the end position. The recess is preferably formed as an interior snap ring groove.

The activity involved in putting together the connector, pre-locked with the secondary locking mechanism, and the connector takes place accordingly in two stages:

First, the locking mechanism and case in the pre-assembled position are guided together; then the locking mechanism is released from the blocking position opposite to the case and can be pushed relative to it.

Further properties of the invention arise from the properties of the subclaims as well as the any other application documents.

The invention is explained in greater detail below by use of working examples.

BRIEF DESCRIPTION OF THE DRAWINGS

In this connection the following are shown in schematic representation.

DETAILED DESCRIPTION OF THE PREFERRED EMBODIMENT

In the figures the same components or equally acting components are designated and represented by the same reference numbers.

Figure 1A:
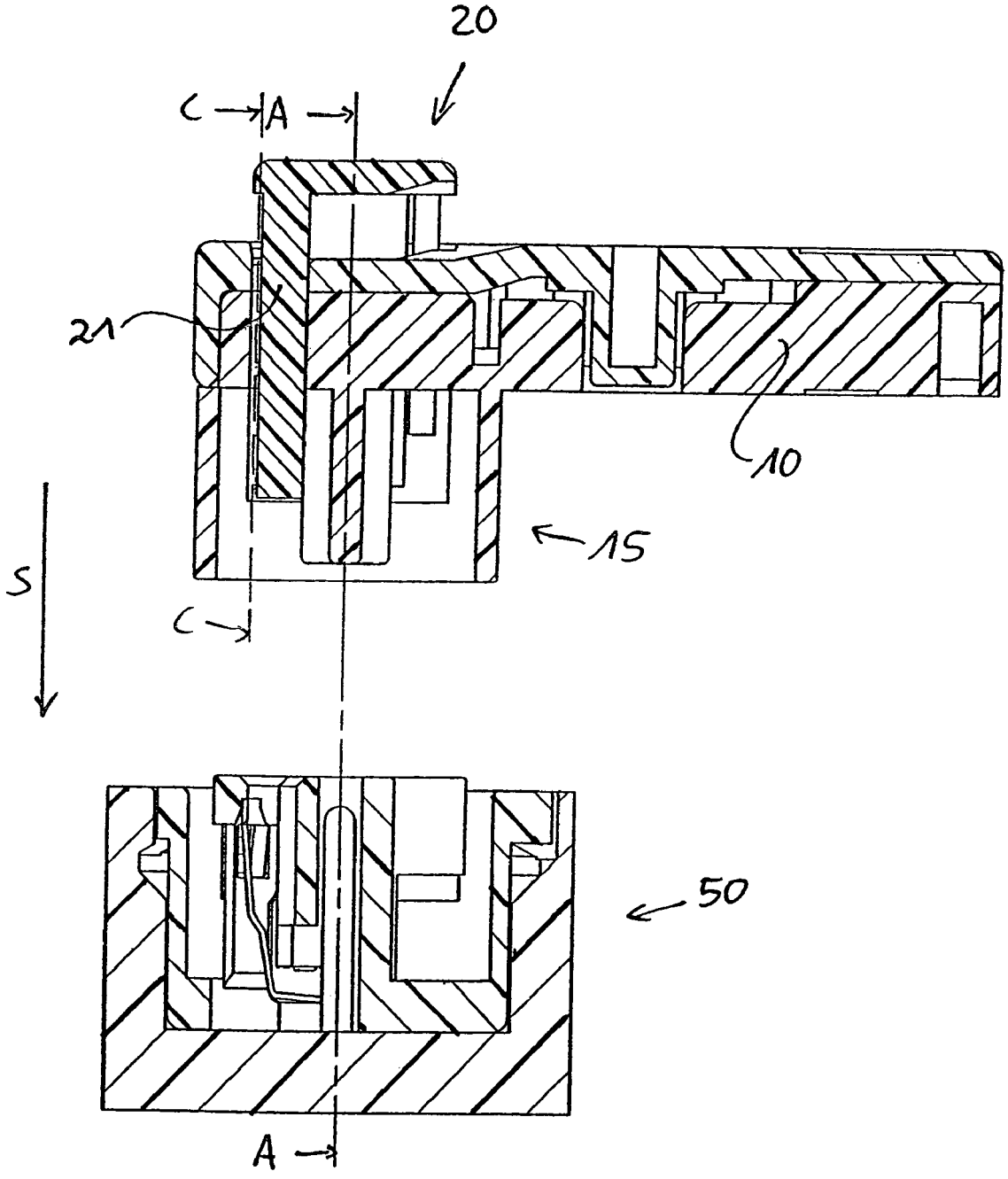
FIG. 1*a* is a cut-out side view of a pin-and-socket connector according to cut line B—B from FIG. 1*b* in a pre-assembled state, separated from a socket.
Figure 1:
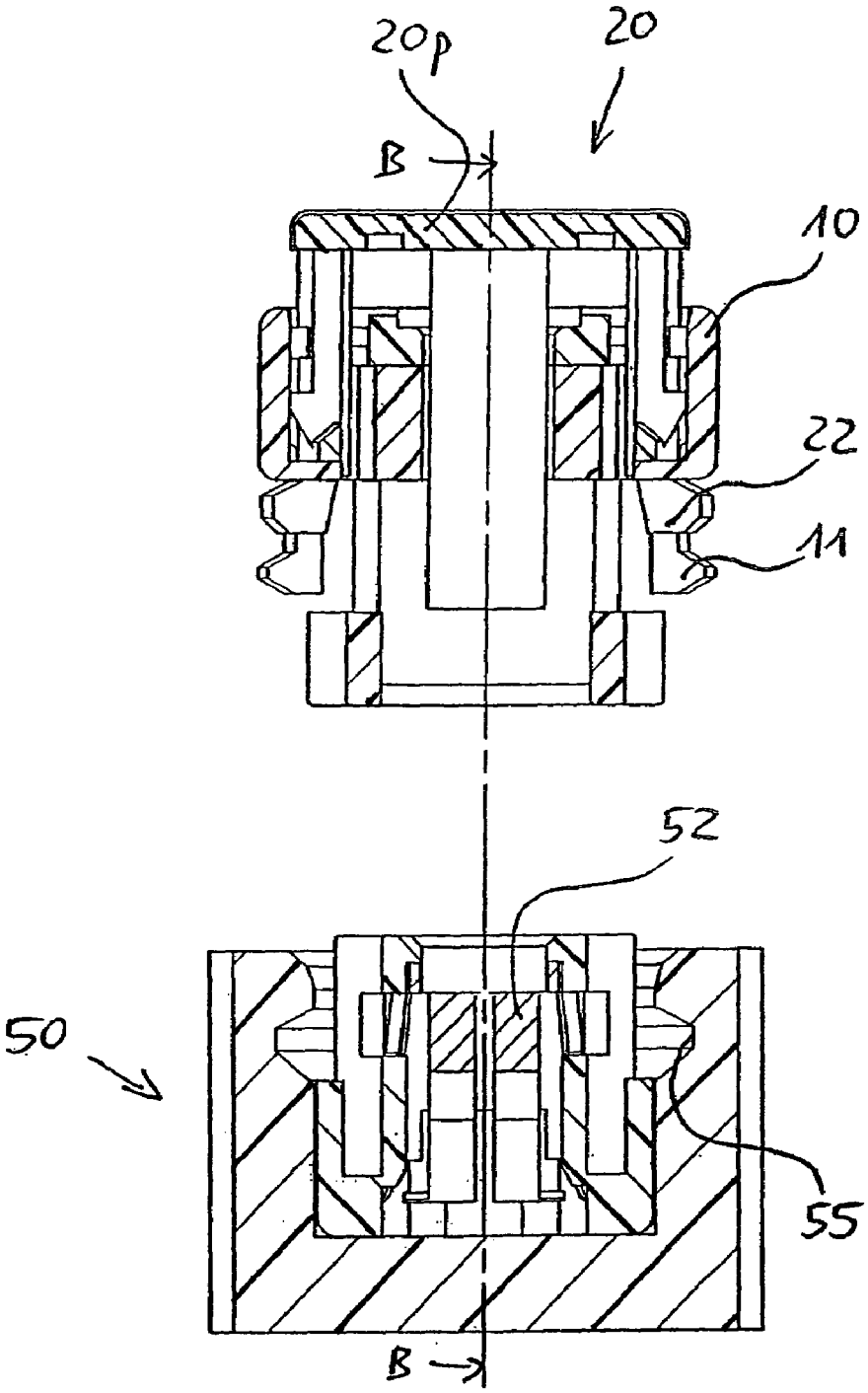
FIG. 1*b* is a cut-out front view of the pin-and-socket connector according to cut line A—A from FIG. 1*a* in a pre-assembled state, separated from the socket.
FIG. 1*c* is a perspective view of the pin-and-socket connector in a pre-assembled state.
Figure 1C:
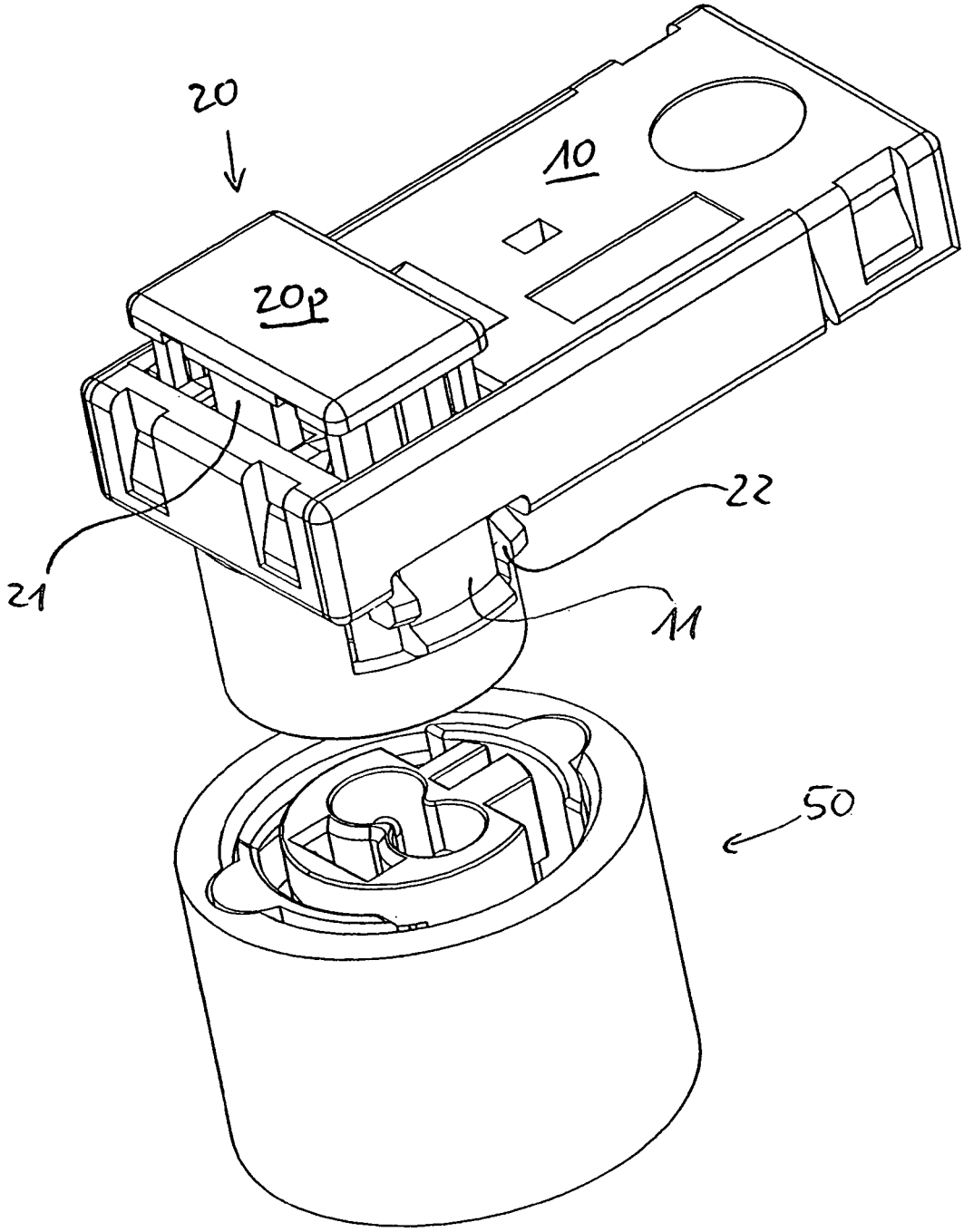
Figure 2A:
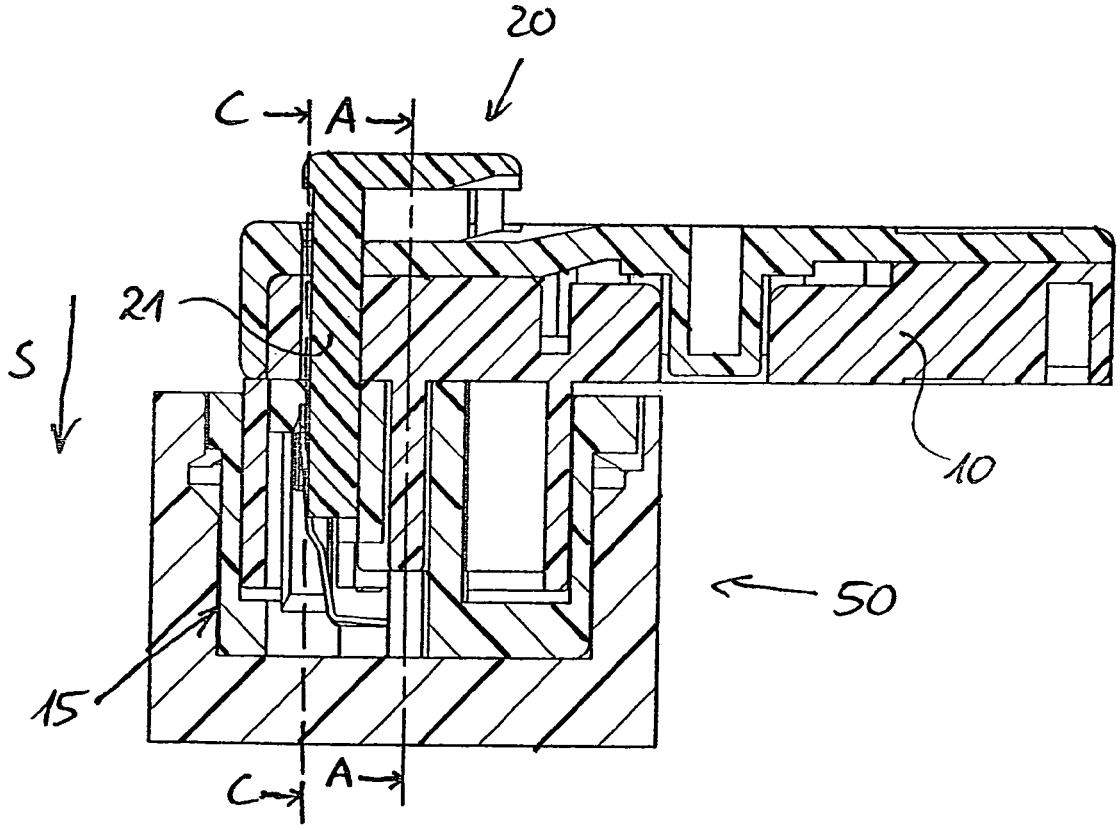
FIG. 2*a* is a cut-out side view of a pin-and-socket connector according to cut line B—B in FIG. 2*b* in an inserted, unsecured state.
Figure 2B:
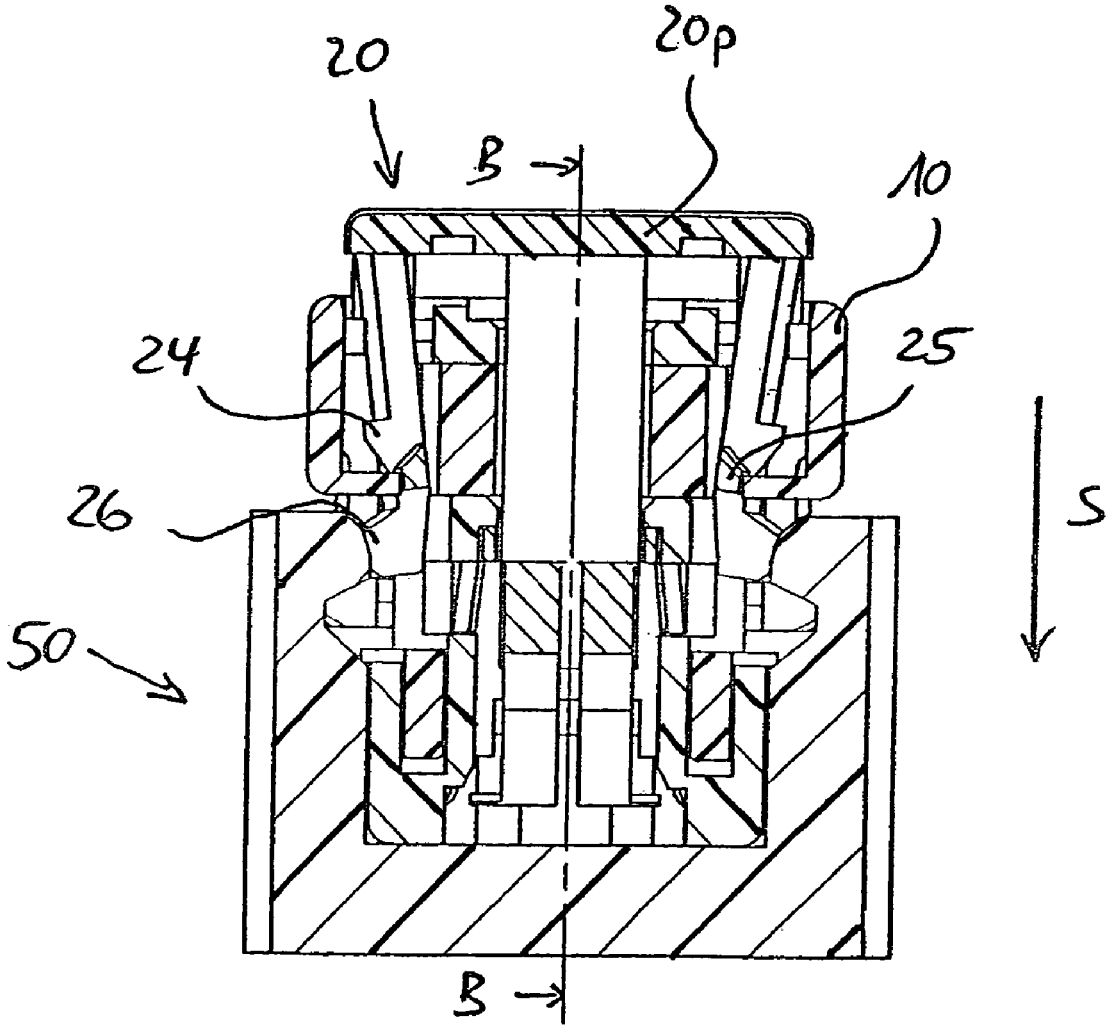
FIG. 2*b* is a cut-out front view of the pin-and-socket connector according to cut line A—A in FIG. 2*a* in an inserted, but not secured condition.
Figure 2C:
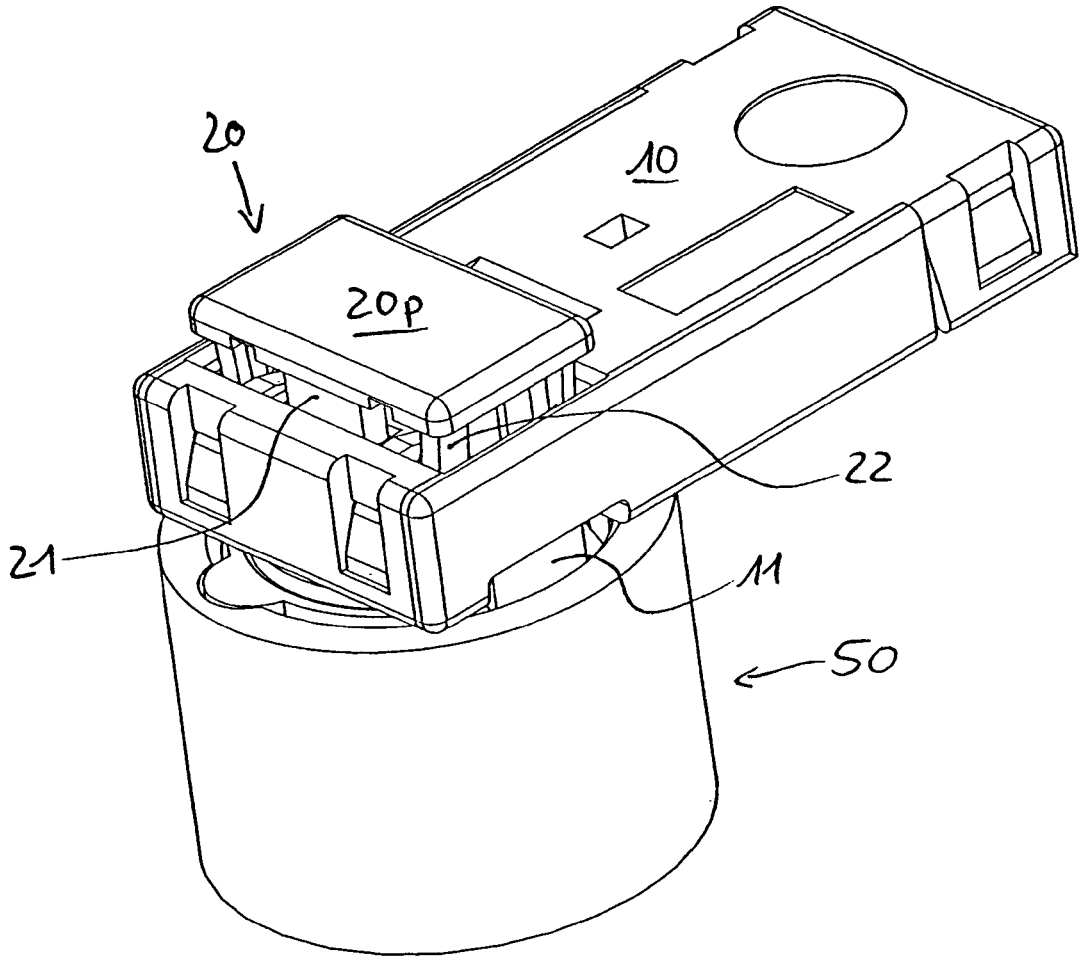
FIG. 2*c* is a perspective view of the pin-and-socket connector in an inserted, but not secured state.
Figure 3A:
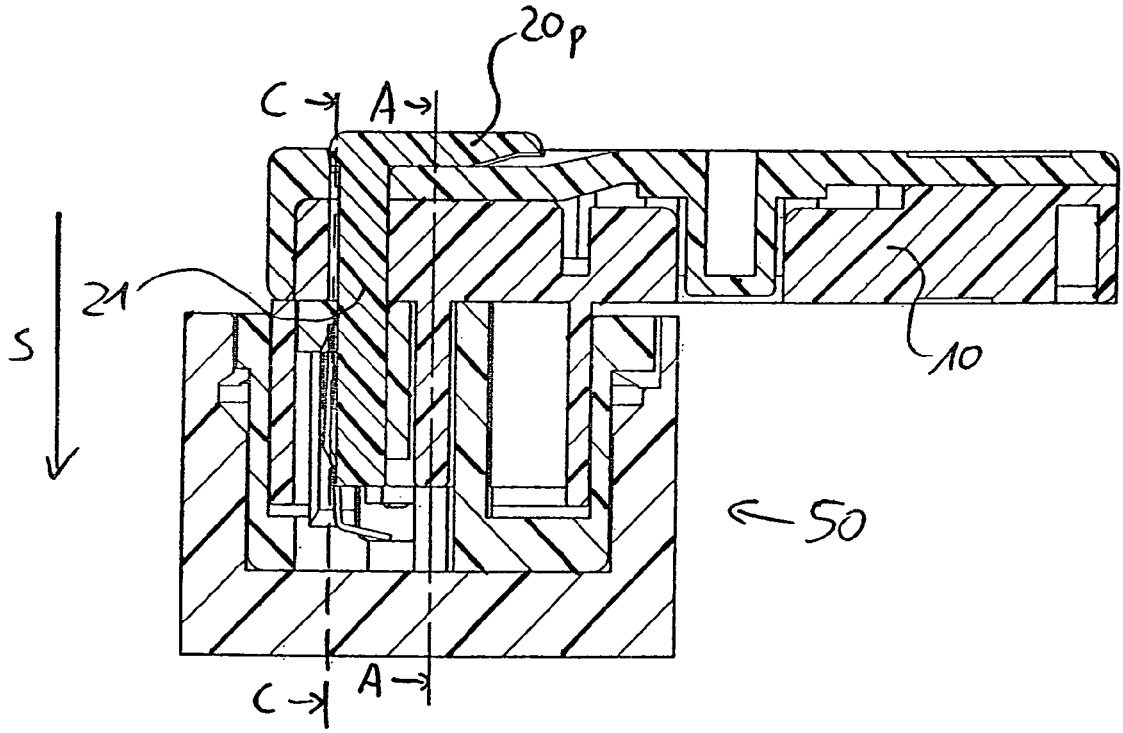
FIG. 3*a* is a cut-out side view of a pin-and-socket connector according to cut line B—B from FIG. 3*b* in an inserted and secured state.
Figure 3B:
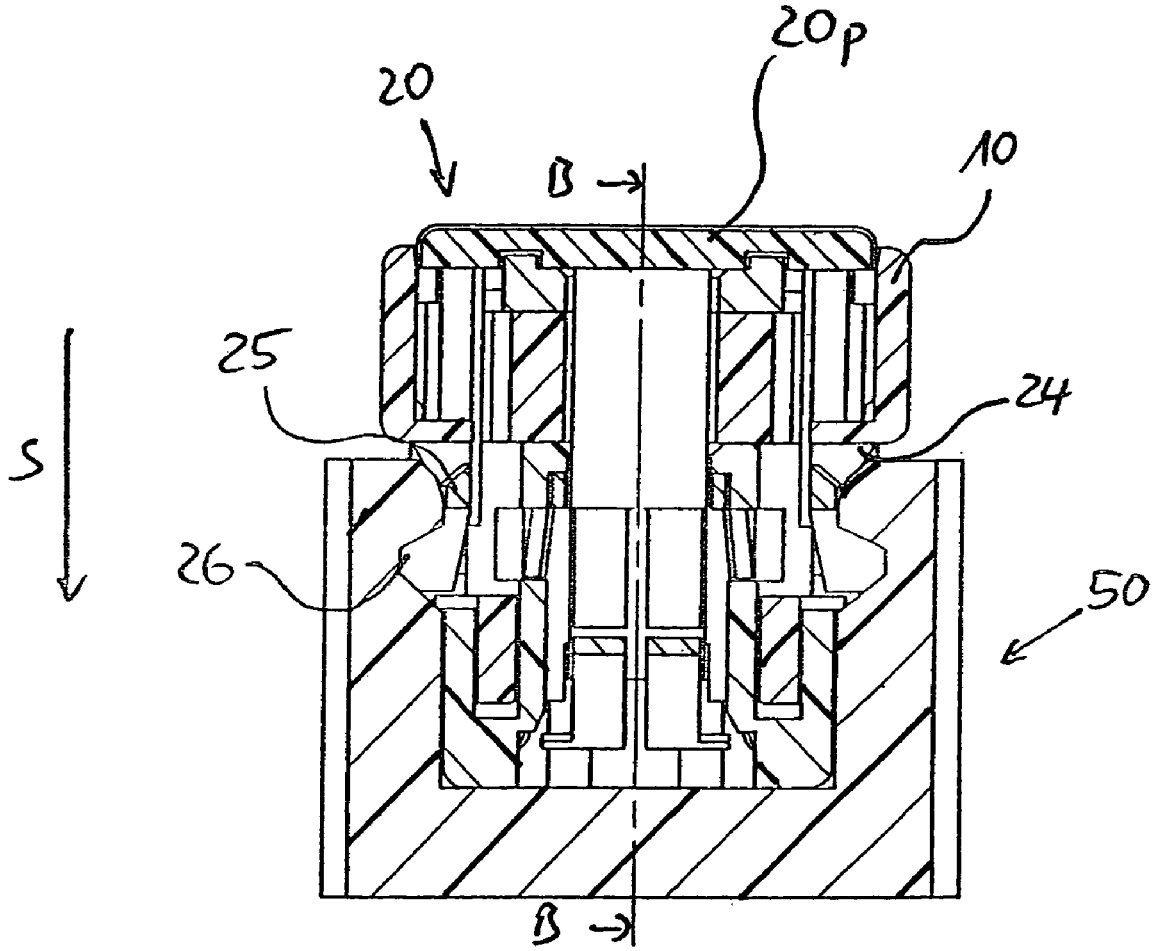
FIG. 3*b* is a cut-out front view of the pin-and-socket connector according to cut line A—A in FIG. 3*a* in an inserted, secured state.
Figure 3C:
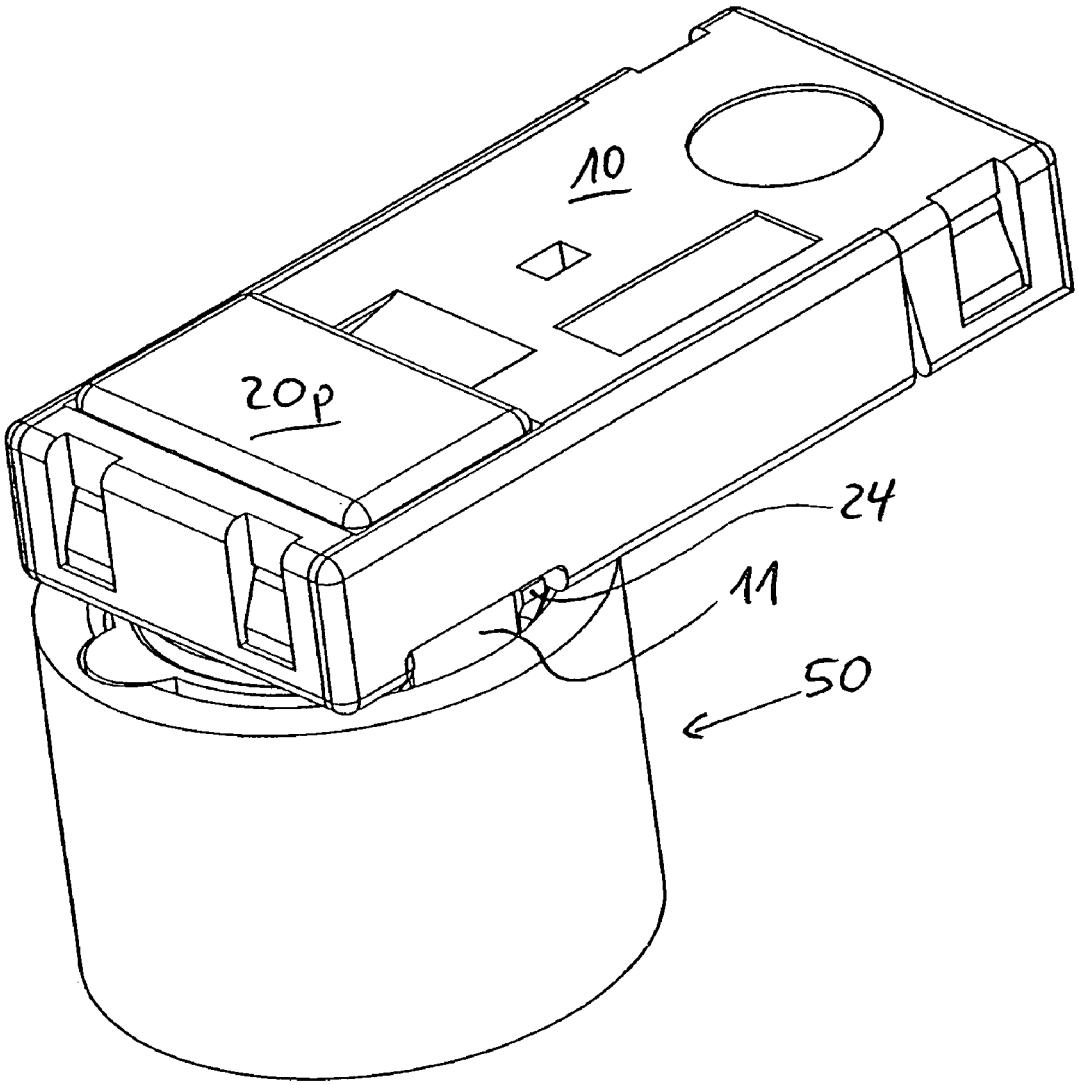
FIG. 3*c* is a perspective view of the pin-and-socket connector in an inserted state.

The pre-assembly position represented in FIGS. 1*a*, 1*b*, and 1*c* shows an electrical pin-and-socket connector consisting of a case 10 and a secondary locking mechanism 20 in a pre-assembled state over a socket 50, also designated as a primer or igniter.

The components are represented in greatly enlarged form and thus are not true to scale. The L-shaped connector represented FIG. 1*a* has, for example, a height of about 10 mm and a width of about 20 mm.

In insertion direction S openings run in the case 10, in which contact springs, which are not shown, are arranged and which make contact with the corresponding contact pins 52 of the socket 50 corresponding to the plug in the locking state of the plug and socket 50.

To make the insertion process easier, the secondary locking mechanism 20 is positioned in the insertion direction S over a nozzle 15 of the case 10 and guided in the insertion direction S into the case 10. Through such an arrangement a space-saving accommodation of the secondary locking mechanism can be realized.

The case 10 consists of the nozzle 15 and an upper part shaped like a cigarette box. It guides contact elements, if necessary, through a welded-on throttle and cable traction relief to further electrical components and has a separate cover 16. The case 10 can be designed as one part or several parts.

Figure 4:
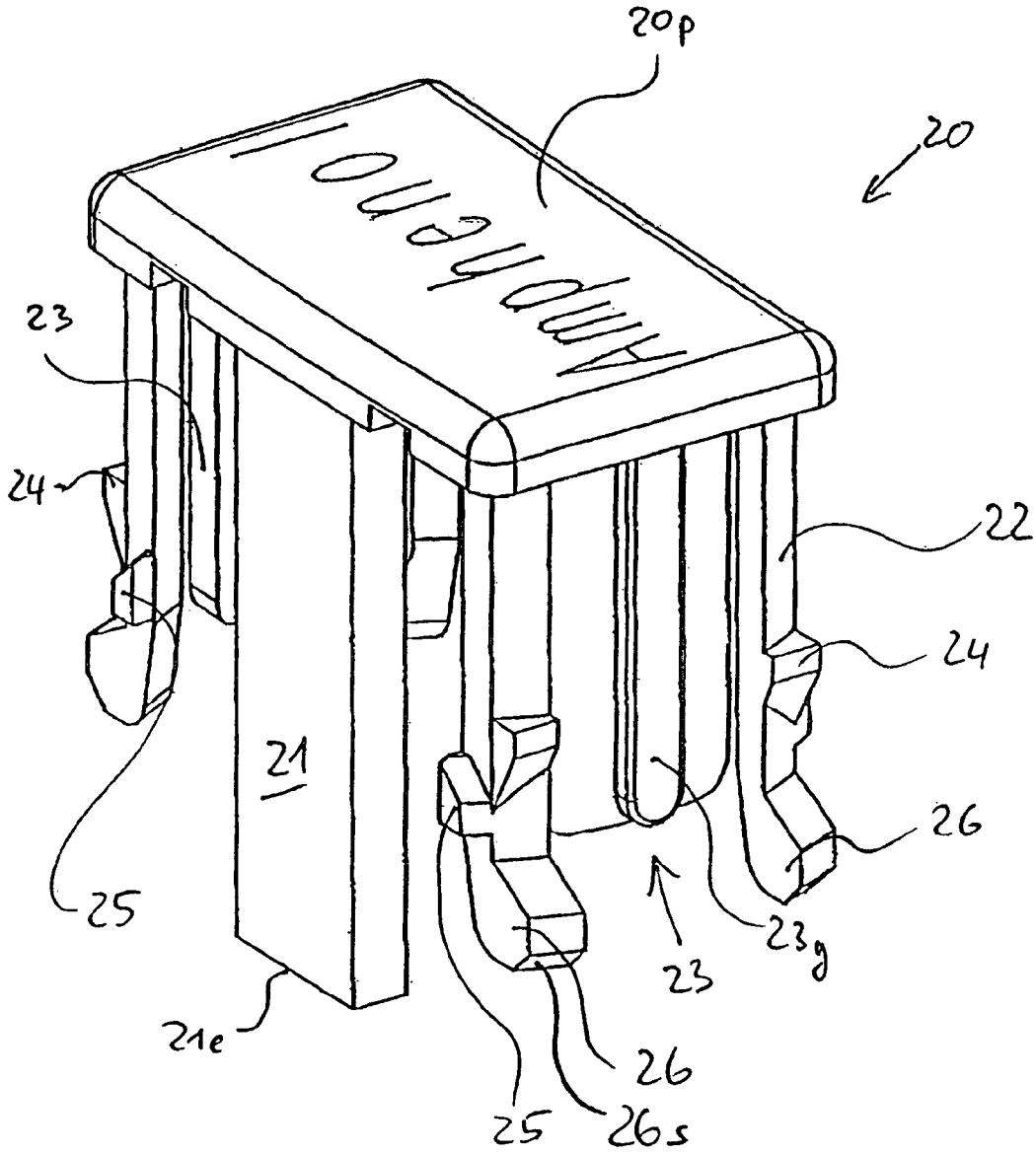
FIG. 4 is a perspective view of a secondary locking mechanism.
Figure 5:
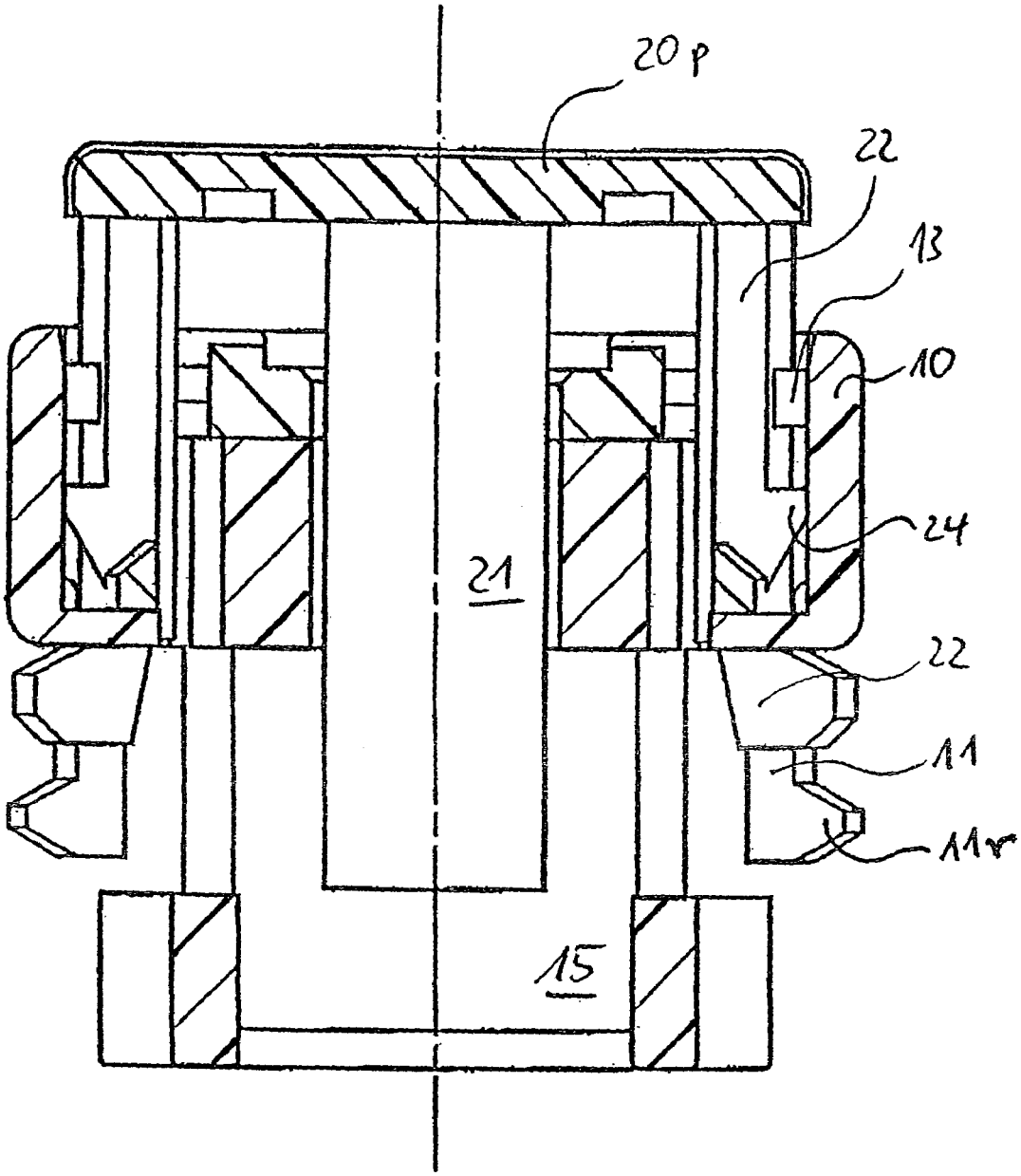
FIG. 5 is a cut-out front view of the pin-and-socket connector according to cut line C—C in FIG. 1*a* in a pre-assembled state.

The secondary locking mechanism 20 consists of an essentially rectangular basis plate 20*p*, positioned parallel to the plane of the case 10, with the basis plate having actuators 22 on its four corners extending in insertion direction S, a profile guide rib 21, and two arms 23, as is shown in the blow up in FIG. 4.

The case 10 has recesses and indentations for inserting, guiding, and securing the secondary locking mechanism 20 in its front section positioned over the nozzle 15. In the insertion direction to the socket 50 runs the nozzle 15, which has a shape adapted to the socket 50 (in the present case cylinder shaped).

The actuator 22 consists of a material that allows for a springiness of the actuator—for example, plastic. On the actuator 22, which can also be designated as a stop lance, various projecting parts have been mounted, which are important for the function of the secondary locking mechanism 20.

In delivery state, in which the secondary locking mechanism 20 is pre-assembled with the case 10, as is shown in FIGS. 1*a*, 1*b*, and 1*c* and 5, an upper projecting part 24, working together with a corresponding projecting part 13 on the case 10, prevents the secondary locking mechanism 20 from being pulled out of the case 10. Below it the freedom of motion of the secondary locking mechanism 20 is limited in the case 10 by the middle projecting part 25, which extends to the underpart of the case above the nozzle 15. In the pre-assembled state all the components of the secondary locking mechanism 20 are positioned essentially without mechanical tension in the case 10.

The case 10 has a primary locking mechanism 11, which is positioned next to the nozzle 15 and which also extends in the insertion direction S. The primary locking mechanisms 11 are designed as two arms 11, on whose ends detents 11*r* are mounted, which intermesh in a corresponding recess 55 of the socket 50 when the plug is inserted into the socket 50.

The arms 11 are positioned in the end position between two actuators 22 on the short side of the basis plate 20*p*, whereby the arms 11 are mounted on the case 10 and the actuators 22 on the secondary locking mechanism 20.

Figure 6:
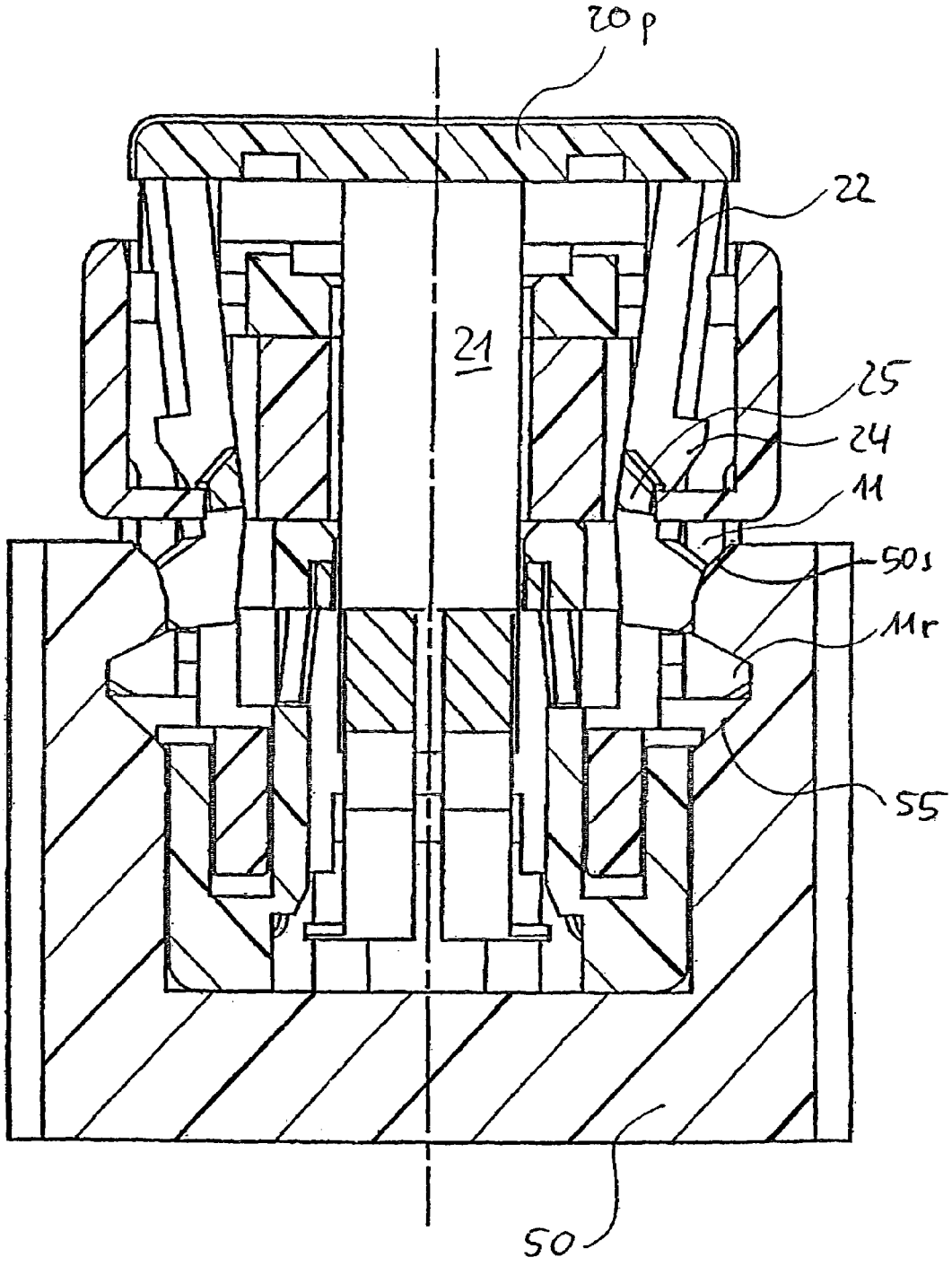
FIG. 6 is a cut-out partial view of the pin-and-socket connector according to cut line C—C in FIG. 2*a* in an inserted, not yet locked state.

Shortly before reaching the locking position of the detents 11*r* in the recess 55, a lower slanted surface 26*f* of a lower projecting part 26 of the actuator 22 runs at a corresponding angle 50*s* of the socket 50, as a result of which each actuator 22 is pressed inward against its spring force and as a result the middle projecting part 25 is moved away from the bearing surface of the case 10 and guided past the bearing surface, as one can see in FIG. 6.

Figure 7:
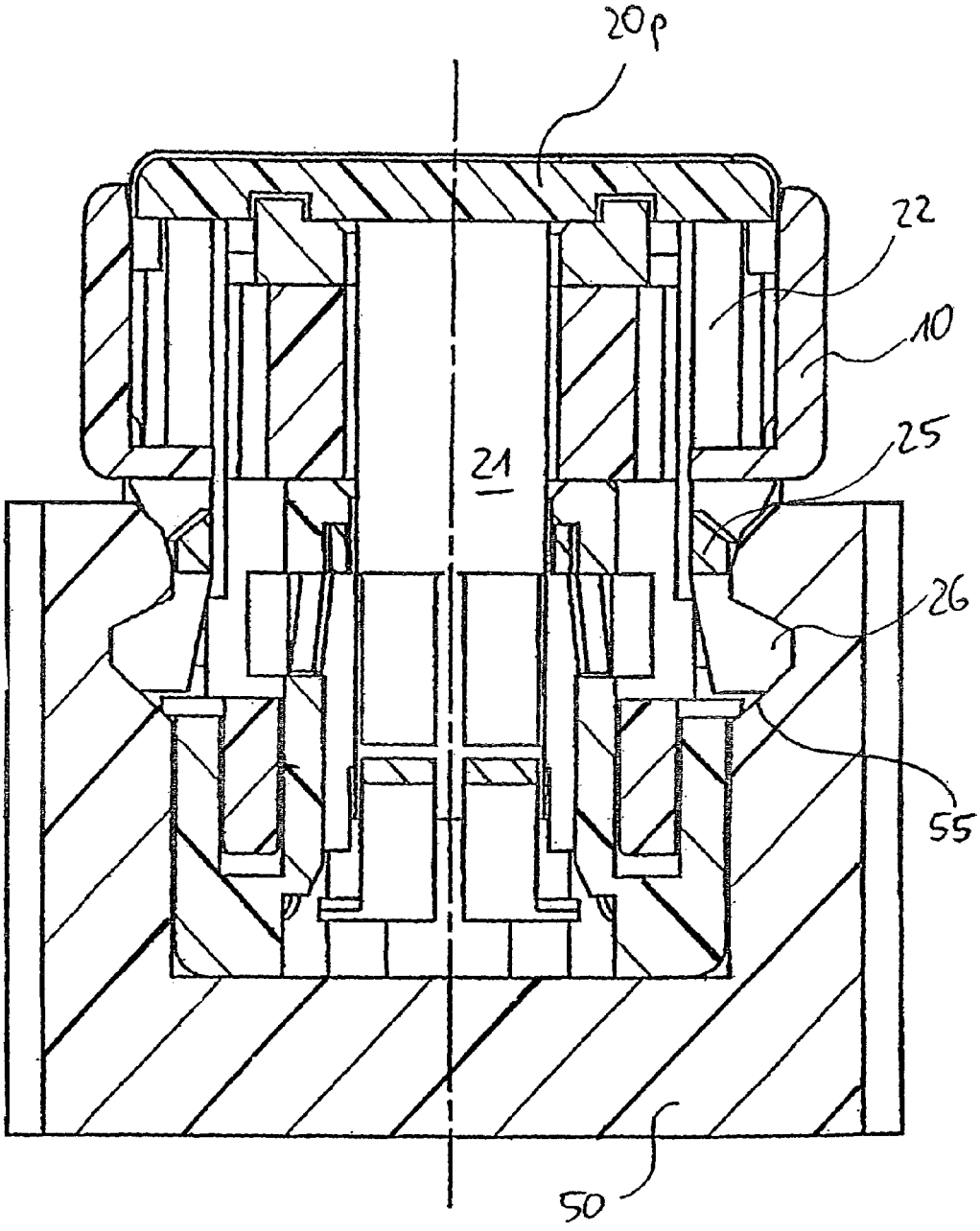
FIG. 7 is a cut-out front view of a connector according to cut line C—C from FIG. 3*a* in an inserted and locked state.

In FIG. 7 one can see that the middle projecting part 25 was guided past the case 10 and was locked into the depicted locked end position of the lower projecting part 26 of the actuator 22 in the recess 55 of the socket 50. For the locking of the lower projecting part 26 a second recess can also obviously be provided in the socket 50. To save space it is, however, advantageous to have the primary locking mechanism 20 lock into a common recess 55. The recess 55 of the socket 50 can be designed as a ring-shaped groove.

In the locked end position the actuators 22 and also the other components of the secondary locking mechanism 20 and the primary locking mechanism 11 lock into the socket without mechanical tension free of force.

The profile guide rib 21 provides for the interruption of a shorting bar, which is not shown here, through the free end 21*e* of the profile guide rib 21. The profile guide rib 21 serves, in addition, to guide the secondary locking mechanism 20 into a respective profiled recess or opening of the case 10 and the socket 50.

The arm 23 provides for the locking of the primary locking device 11 in the locked end position of the electrical pin-and-socket connector by pushing the arm 23 when inserting the secondary locking device 20 between the nozzle 15 and the back side of the primary locking mechanism 11 that is turned away from the detent 11*r*.

A guide bar 23*g* of the arm 23 serves to give further precision to the vertical guiding of the secondary locking mechanism 20 in the case 10 along the insertion direction S.

The basis plate 20 *p* has on its underside recesses that lock into the corresponding projecting parts or ramps of the cover of the case so that the secondary locking mechanism 20 essentially lies on a plane with the cover of the case 10.

LIST OF REFERENCE NUMBERS

10 case
11 primary locking mechanism
11*r* detent
13 projecting part
15 nozzle
16 cover
20 secondary locking mechanism
20*p* basis plate
21 profile guide rib
21 *e* free end
22 actuator
23 arms
23*g* guide bar
24 upper projecting part
25 middle projecting part
26 lower projecting part
26*f* lower slanted surface
50 socket
50*s* angle
52 contact pins
55 recess
S insertion direction Although certain presently preferred embodiments of the invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

The invention claimed is:

1. Electrical pin-and-socket connector, for use between a socket and an electrical control unit for a retention system in motor vehicles, comprising:

a case for receiving electrical, connected contact elements for making contact with corresponding contact parts of the socket, whereby the case has a primary locking mechanism to lock the case with the socket, a secondary locking mechanism guided relative to the case with at least one actuator, which projects substantially vertically from a basis plate of the secondary locking mechanism, wherein the secondary locking mechanism is capable of being moved back and forth between a pre-locking position for locking with the case and a locked end position for locking with the socket, wherein the actuator is formed so it is springy and it is positioned in the end position to work with a recess of the socket and the secondary locking mechanism is positioned to lock in behind the primary locking mechanism, and wherein the actuator and primary locking mechanism are adapted to being locked in the end position in a recess, wherein the actuator is unstressed in the end position, and whrein an upper projecting part, working together with a corresponding projecting part on the case, prevents the secondary locking mechanism from being pulled out of the case in the pre-locking position.

2. Pin-and-socket connector according to claim 1, in which the actuator consists of plastic.

3. Pin-and-socket connector according to claim 1, in which four actuators are provided on the secondary locking mechanism and the actuators are preferably positioned on the corners of the basis plate.

4. Pin-and-socket connector according to claim 1, in which the recess is formed as an interior snap ring groove.

5. Pin-and-socket connector according to claim 1, in which the basis plate locks in the end position to a great extent flush with the upper side of the case.

6. Pin-and-socket connector according to claim 1, in which a profile guide rib has such a length that it releases in the end position with its free end an effective shorting bar between the contact parts and/or contact elements.

7. Pin-and-socket connector according to claim 1, in which the primary locking mechanisms in the end position is taken hold of from behind by arms so that a release of the primary locking mechanism from a recess of the socket is prevented.

8. Pin-and-socket connector according to claim 1, in which the primary locking mechanisms is positioned in the end position in each case between two actuators.

* * * * *

UNITED STATES PATENT AND TRADEMARK OFFICE

CERTIFICATE OF CORRECTION

PATENT NO. : 7,121,867 B2
APPLICATION NO. : 11/312544
DATED : October 16, 2006
INVENTOR(S) : Alfred Annecke It is certified that error appears in the above-identified patent and that said Letters Patent is hereby corrected as shown below:

Col. 6, line 37, change “a” (first instance) to --the--.

Col. 6, line 42, change “is” to --are--.

Signed and Sealed this

Thirty-first Day of July, 2007

JON W. DUDAS
*Director of the United States Patent and Trademark Office*

UNITED STATES PATENT AND TRADEMARK OFFICE

CERTIFICATE OF CORRECTION

PATENT NO. : 7,121,867 B2
APPLICATION NO. : 11/312544
DATED : October 17, 2006
INVENTOR(S) : Alfred Annecke It is certified that error appears in the above-identified patent and that said Letters Patent is hereby corrected as shown below:

Col. 6, line 37, change "a" (first instance) to --the--.

Col. 6, line 42, change "is" to --are--.

This certificate supersedes Certificate of Correction issued July 31, 2007.

Signed and Sealed this

Twenty-first Day of August, 2007

JON W. DUDAS
*Director of the United States Patent and Trademark Office*